US005540491A

United States Patent [19]

Wu

[11] Patent Number: 5,540,491

[45] Date of Patent: Jul. 30, 1996

[54] BED, DESK AND CABINET ASSEMBLY

[76] Inventor: Teng-Cheng Wu, P.O. Box No. 2103, Taichung Hsien, Taiwan

[21] Appl. No.: 261,403

[22] Filed: Jun. 20, 1994

[51] Int. Cl.[6] ..... A47B 83/00

[52] U.S. Cl. ..... 312/237; 5/2.1

[58] Field of Search ..... 312/237, 196; 108/50, 4, 5; 5/2.1, 3

[56] References Cited

U.S. PATENT DOCUMENTS 4,253,206 3/1981 Tasaka ..... 5/2.1

4,312,086 1/1982 Bianco ..... 5/2.1

FOREIGN PATENT DOCUMENTS 2648026 12/1990 France ..... 5/2.1

2137082 10/1984 United Kingdom ..... 5/2.1

*Primary Examiner*—Peter M. Cuomo

*Assistant Examiner*—Gerald A. Anderson

[57] ABSTRACT

A bed, desk and cabinet assembly includes a bed, a desk and a cabinet and six supporting posts for supporting the bed, the desk and the cabinet to a predetermined position. The bed is disposed above the desk and the cabinet. Accordingly, a multi-functional assembly is achieved.

6 Claims, 5 Drawing Sheets

BED, DESK AND CABINET ASSEMBLY

BACKGROUND OF THE INVENTION

This invention relates to an assembly, more particularly, to a bed, desk and cabinet assembly. This assembly includes a bed, desk, a cabinet and six supporting posts. The bed is disposed at the upper portion of the desk and the cabinet. Each of the bed, desk and the cabinet is supported by those six posts, accordingly, a versatile and functional assembly is achieved.

The existing bed, desk and cabinet are all an individual article which can not be assembled together. In the modern society, the space provided by the room is very small. As a result, the space shall be planned and used economically. If the space is filled of the bed, desk and cabinet, not only will the space be wasted, but also will bring some inconvenience because of the narrow space.

SUMMARY OF THE INVENTION

It is the object of this invention to provide a bed, desk and cabinet assembly which has a compact buck size, accordingly, this assembly occupies only a small space. Accordingly, a larger space is saved.

It is still the object of this invention to provide a bed, desk and cabinet assembly wherein a bed, a desk and a cabinet are included in a single assembly, accordingly, the expense on furniture are saved.

In order to achieve the objects set forth, the bed, desk and cabinet assembly made accordingly to this invention includes a bed, a desk, a cabinet and six supporting posts. Each of the bed, the desk and the cabinet is supported by those six supporting posts in a rectangular configuration. The bed is disposed above the desk and the cabinet. The desk is disposed at the left side of the cabinet wherein two supporting posts are disposed and supported between the desk and the cabinet. The peripheral of the bed is provided with a protecting fence which has an entry at the position above the cabinet. A ladder is provided at one side of the cabinet. The doors of the cabinet are provided at right side of the assembly. The desk is incorporated with positioning rods both at the upper surface and the underside surface. These positioning rods can be attached by a clipping means disposed at the holding beam bridged between two adjacent supporting posts. The level of the desk is adjustable through the function of the positioning rods and the clipping means.

BRIEF DESCRIPTION OF THE DRAWINGS

The structural and operational characteristics of the present invention and its advantages as compared to the known state of the prior art will be better understood from the following description, in conjunction with the attached drawings which show illustratively but not restrictively an example of a bed, desk and cabinet assembly. In the drawings.

DETAILED DESCRIPTION OF A PREFERABLE EMBODIMENT

Figure 1:
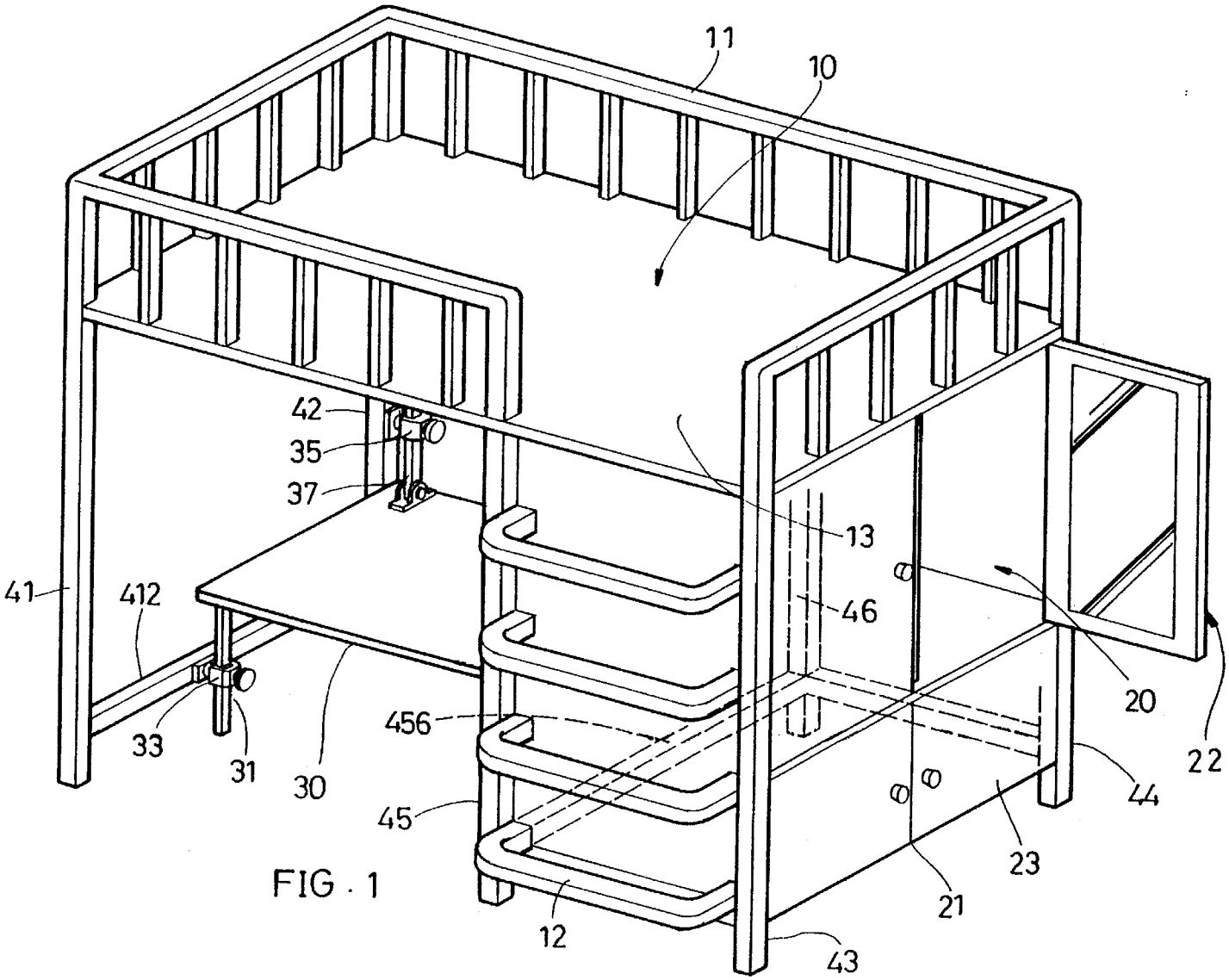
FIG. 1 is a perspective view of the assembly made accordingly this invention.
Figure 2:
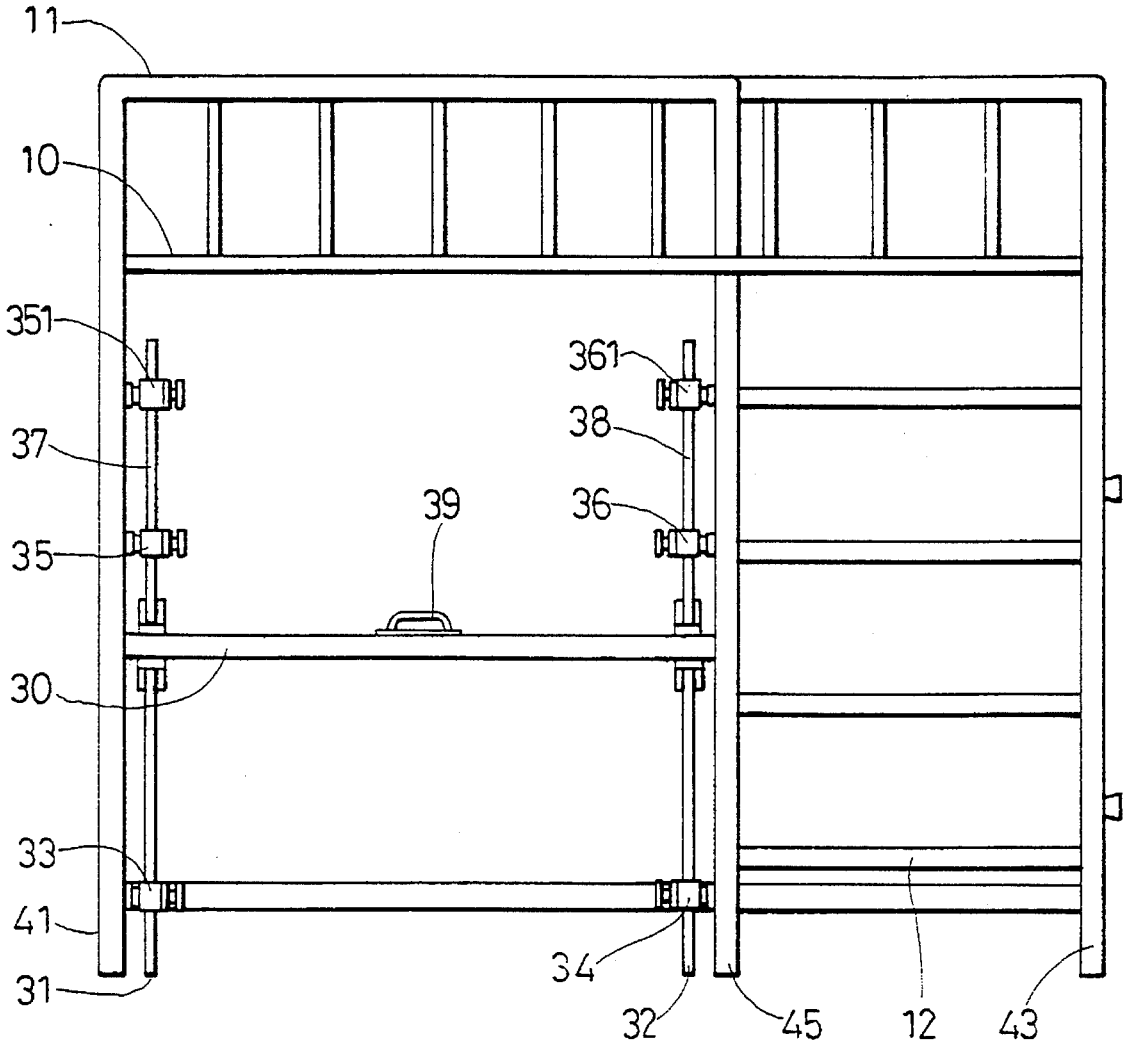
FIG. 2 is a front view of the assembly made according to this invention.

Referring to FIGS. 1 and 2, the bed, desk and cabinet assembly made accordingly to this invention includes a bed 10, a desk 30, a cabinet 20 and six supporting post. Said bed 10 is a horizontal rectangular plate having two longer sides, two shorter sides, and four corners; further, defining one of the shorter sides of said bed 10 as the left side and the other shorter side as the right side. Four of the six vertical supporting posts 41, 42, 43 & 44 are connected with said four corners of said bed 10. Thus, the other two posts 45 and 46 divide said bed 10 into a left portion above said desk 30 and a right portion above said cabinet 20. The bed 10 is supported by four supporting posts 41, 42, 43 and 44 and is disposed above the cabinet 20, 21 and the desk 30. A pair of supporting posts 45, 46 are disposed and supported between the desk 30 and the cabinet 20. The desk 30 and the cabinet 20 which are disposed under the bed 10 are also be separated by these two supporting posts 45, 46.

The peripheral of the bed 10 is provided with a protective fence 11. An entry 13 is provided at the protective fence 11 at the position above the cabinet 20. A ladder 12 is provided at the sides 21 of the cabinet 20. The ladder 12 extends between the bed 10 and the floor. The open doors 22, 23 are disposed at the right side 21 of the cabinet 20.

Two positioning rods 37, 38 are disposed at the rear portion of the desk 30. Besides, two supporting rods 42, 46 are disposed adjacent to said positioning rods 37, 38 respectively. Each of said positioning rods 37, 38 is disposed with a clipping means 35, 351, 36 and 361. By this arrangement, the desk 30 is movable along the positioning rods 37, 38 through the clipping means 35, 351, 36 and 361.

On the other hand, the front portion of the desk is disposed with two positioning rod 31, 32. A horizontal rod 412 is bridged between the supporting posts 41 and 42. Another horizontal rod 456 is disposed between the supporting posts 45, 46. Each of the horizontal rods 412, 456 is provided with a clipping means 33, 34 which has the same configuration with the clipping means 35, 36. Each of the positioning rods 31, 32 is received by said clipping means 35, 36 respectively. Accordingly, the level of the desk 30 is adjustable through the arrangement between the positioning rods 33, 34, 37 and 38 and the clipping means 31, 32, 35 and 36. The user can adjust the level of the desk 30 easily to meet their individual requirement. Furthermore, for an easy adjustment, a handle 39 is provided at the rear portion of the desk 30 for easy controlling.

Referring to FIG. 2, the positioning rods 37, 38 disposed at the rear portion of the desk 30 and the positioning rods 31, 32 are pivoted thereof. Besides, the clipping means 33, 34 are also pivoted thereof. In light of this, the desk 30 can be tilted to a desired angle for easy writing.

Figure 3:
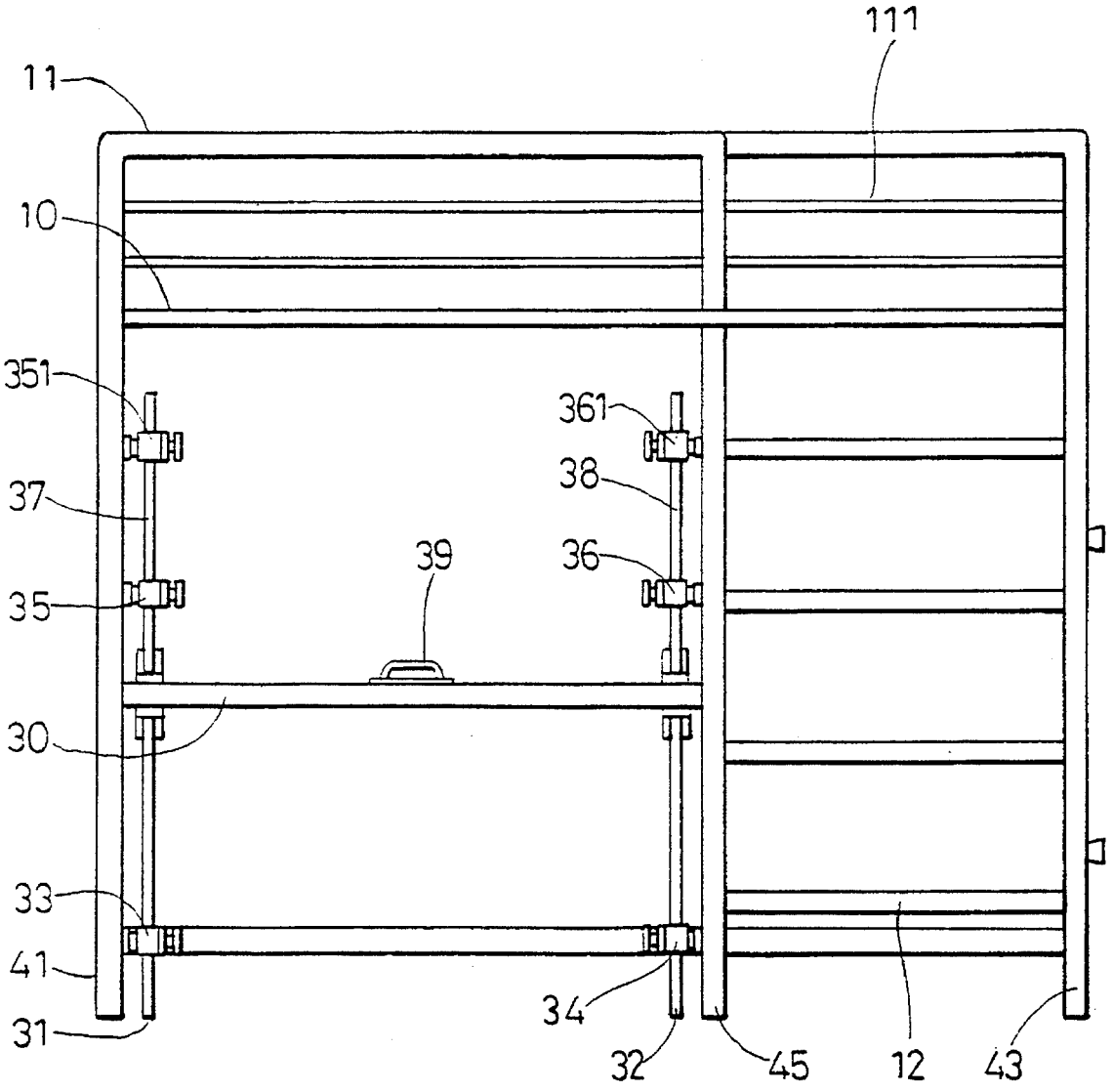
FIG. 3 is a second embodiment of the assembly made according to this invention.
Figure 4:
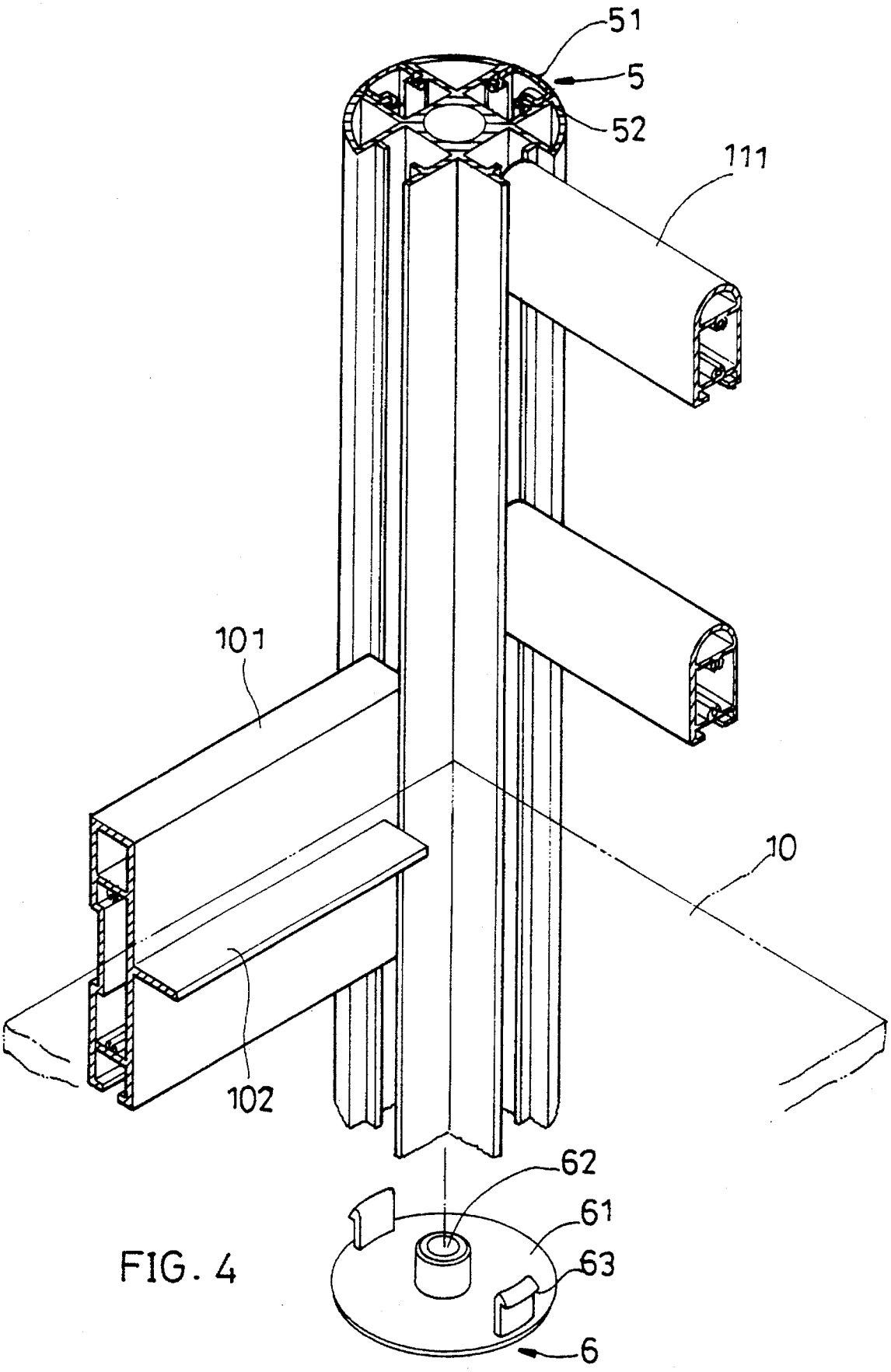
FIG. 4 is a cross sectional view the supporting post made according to this invention.
Figure 5:
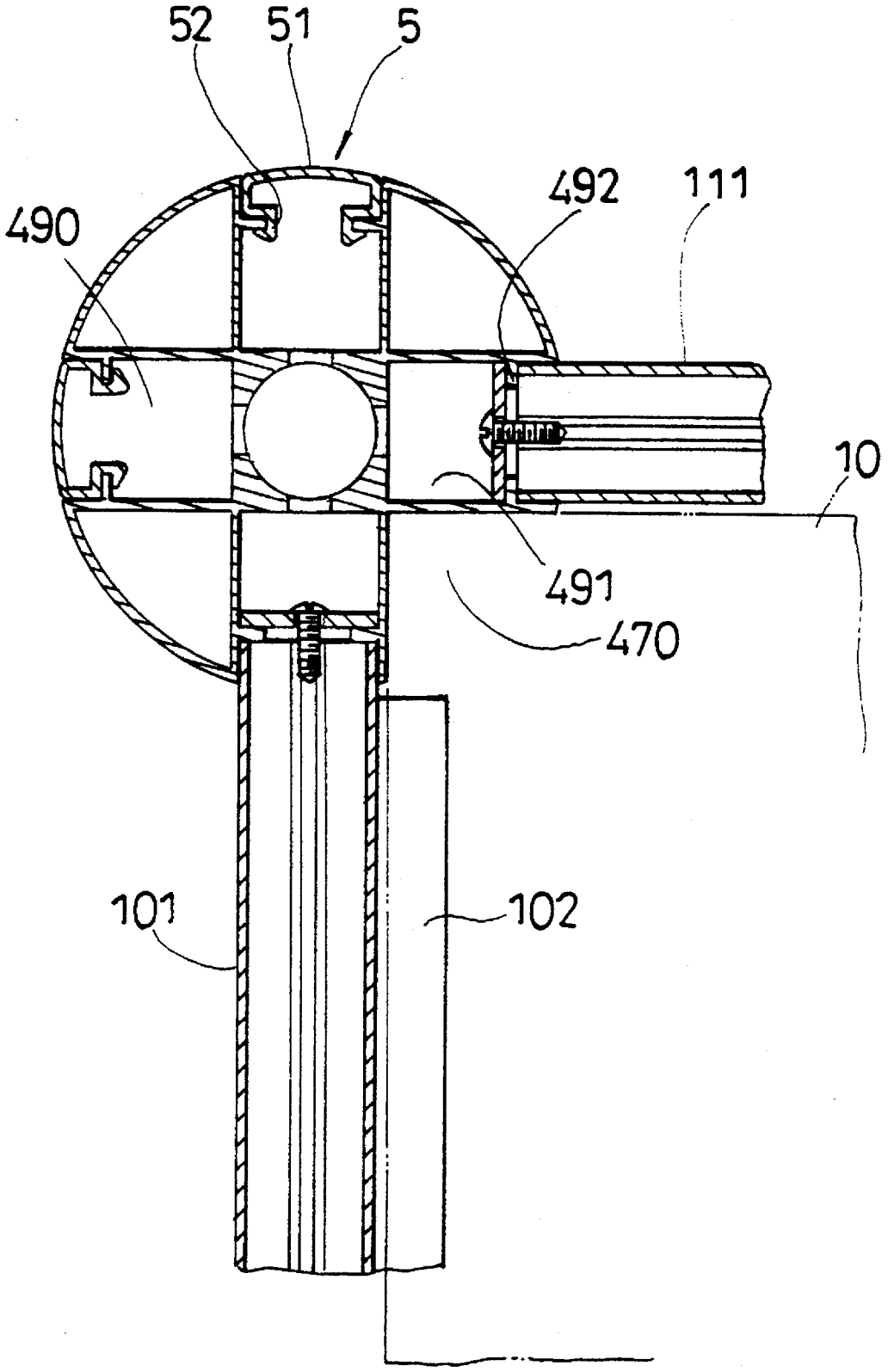
FIG. 5 is a cross sectional view of the supporting post made according to this invention.

Referring to FIGS. 3, 4 and 5, those six supporting posts 41, 42, 43, 44, 45 and 46 are provided with a recess 470, a central portion 480 and four longitudinal slots 490 arranged and spaced in ninety (90) degrees. The longitudinal slot 490 includes a slot portion 491 which has a predetermined shape and is parallel to the central axis of the supporting post. The longitudinal slot 490 further includes a retaining portion 492.

Referring to FIGS. 3, 4 and 5, each of the four horizontal supporting rods 131 of the bed 10 is provided with a projected rib 102, two auxiliary positioning plate 103 and two group of positioning member 104. The bed 10 is bridged onto two opposite projected ribs 102, accordingly, the weight of the bed 10 is supported by the projected ribs 102 evenly. Those two group positioning plate 103 are disposed and retained within said retaining portion 492 of the longitudinal slot 490. Those two group of positioning members 104 are interconnected and fixed to said horizontal supporting rods 131 and the auxiliary positioning plate 103, accordingly, it can be attached to the supporting posts 41, 42, 43, 44, 45 and 46.

Still referring to FIGS. 3, 4 and 5, both ends of the horizontal fence 111 is attached to the longitudinal slot 490 by means of the auxiliary positioning plate 103.

Referring to FIGS. 3, 4 and 5, the assembly includes a plurality of protecting plate 5. Each of said protecting plate 5 includes a round surface portion 51 which has the same curvature of the supporting post to enclose the longitudinal slot 490. The protecting plate 5 further includes a pair of hooks 52.

As described above, the assembly further includes an end cap 6. This end cap 6 includes a cap body 61 which has a sliding surface. The end cap 6 further includes a projected post 62 to be received within the positioning portion 63 of the longitudinal slot 490.

Although the present invention has been described in connection with the preferred embodiments thereof, many other variations and modifications will now become apparent to those skilled in the art without departing from the scope of the invention. It is preferred, therefore, that the present invention not be limited by the specific disclosure herein, but only by the appended claims.

I claim:

1. A bed, desk and cabinet assembly including a bed, a desk, a cabinet and six supporting posts, each of the bed, the desk and the cabinet being supported by said six supporting posts in a rectangular configuration, said bed being disposed above said desk and said cabinet, said bed being a horizontal rectangular plate having two longer sides, two shorter sides, and four corners; further defining one of the shorter sides of said bed as the left side and the other shorter side as the right side; four of the six vertical supporting posts being connected with said four corners of said bed; the other two posts dividing said bed into a left portion above said desk and a right portion above said cabinet, said desk being disposed under the left portion of said bed, said cabinet being disposed under the right portion of said bed, the peripheral of the bed being provided with a protecting fence which has an entry above said cabinet, a ladder being provided at one side wall of said cabinet near said entry, at least one door of the cabinet being provided at right side of said bed of said assembly, the desk having four positioning rods at four corners of said desk respectively, two horizontal beams being connected between two adjacent supporting posts, two of said clipping means being disposed on the horizontal beams, and at least two clipping means being disposed on two of said supporting posts; each clipping means being able to adjusting the positioning rods of said desk so that the height of said desk can be adjusted.

2. An assembly as recited in claim 1, wherein said positioning rods are pivoted to said desk to facilitate a tilted adjustment of the level of said desk.

3. An assembly as recited in claim 1, wherein said supporting posts are provided with a recess, a central portion and four longitudinal slots arranged and spaced in ninety (90) degrees, said longitudinal slot includes a slot portion which has a predetermined shape and is parallel to the central axis of the supporting post, the longitudinal slot further includes a retaining portion.

4. An assembly as recited in claim 3, said bed further has four horizontal supporting rods, wherein each of the four horizontal supporting rods of the bed is provided with a projected rib, two auxiliary position plate and two groups of positioning members, said bed is supported by the projected ribs evenly, said two groups of position plates are disposed and retained within said retaining portion of the longitudinal slot, said two group of positioning members are interconnected and fixed to said horizontal supporting rods and the auxiliary positioning plates of said horizontal supporting rods.

5. As assembly as recited in claim 3, wherein the assembly further includes an end cap, said end cap includes a cap body which has a sliding surface, said end cap further includes a projected post to be received within the positioning portion of the longitudinal slot.

6. An assembly as recited in claim 1, said assembly further comprising a plurality of protecting plates, each of said protecting plate including a round surface portion which has the same curvature of the peripheral surface of the supporting posts to enclose the longitudinal slot in order to form a smooth surface for each longitudinal post, said protecting plate further including a pair of hooks.

* * * * *